United States Patent [19]

Ruggiano

[11] 4,271,998

[45] Jun. 9, 1981

[54] INFANT CARRIER

[76] Inventor: Harriet M. Ruggiano, 5338A NE. Sixth Ave., Oakland Park, Fla. 33308

[21] Appl. No.: 38,222

[22] Filed: May 11, 1979

Related U.S. Application Data

[63] Continuation-in-part of Ser. No. 727,180, Sep. 27, 1976, abandoned.

[51] Int. Cl.[3] ..... A47D 13/02

[52] U.S. Cl. ..... 224/160; 224/242

[58] Field of Search ..... 224/159, 160, 158, 161, 224/242, 191

[56] References Cited

U.S. PATENT DOCUMENTS

| | | | |
|---|---|---|---|
| 2,056,925 | 10/1936 | Kimbrough | 224/159 |
| 2,496,216 | 1/1950 | Kaminski | 224/160 X |
| 3,587,952 | 6/1971 | Higuchi | 224/160 |

FOREIGN PATENT DOCUMENTS

| | | | |
|---|---|---|---|
| 120406 | 10/1949 | Australia | 224/159 |
| 167146 | 11/1950 | Austria | 224/160 |
| 863713 | 1/1941 | France | 224/160 |

*Primary Examiner*—Robert J. Spar
*Assistant Examiner*—Jerold M. Forsberg
*Attorney, Agent, or Firm*—Malin & Haley

[57] ABSTRACT

A two-shoulder trunk-engaging infant carrier for protectively supporting an infant, which includes a substantially thick, cushioned seating platform, removably housed in fabric or fabric-like material. An extension of the fabric projects upward from the bottom-most edges of the platform in the form of a three-sided compartment with a front-closing catch/release and leg partition. A long belt issues from an expandable rim passage and is extendable around the compartment for manipulative control of the infant's posture and movements in a space structured to allow variable margins of freedom. Adjustable carrier-straps adjoin the outside-rear compartment wall horizontally in an area just above the platform and somewhat short of the sides, well below the rim and in use lie symmetrically and harness-like in one continuous stretch, being held around the carrier-person's rib cage by a rear-mounted buckle, thence over the shoulders and anchored under the platform along the forward edge and on the sides of the platform along the two forward edges, so that this hinge-like positioning of the platform allows the infant's weight to tip the seating platform moderately, frontwise or sidewise, easing the impact of shifting weight. Being attached well below the rim, the carrier-straps are free of the rim so that the compartment is free from their caustic pull. Head rests fastened to narrow strapping issuing through the loops holding the carrier-strap shoulder fasteners support the sides of the infant's unsteady head. The substantial vertical thickness of the seating platform also reduces the pressure against the carrier-person's body.

2 Claims, 6 Drawing Figures

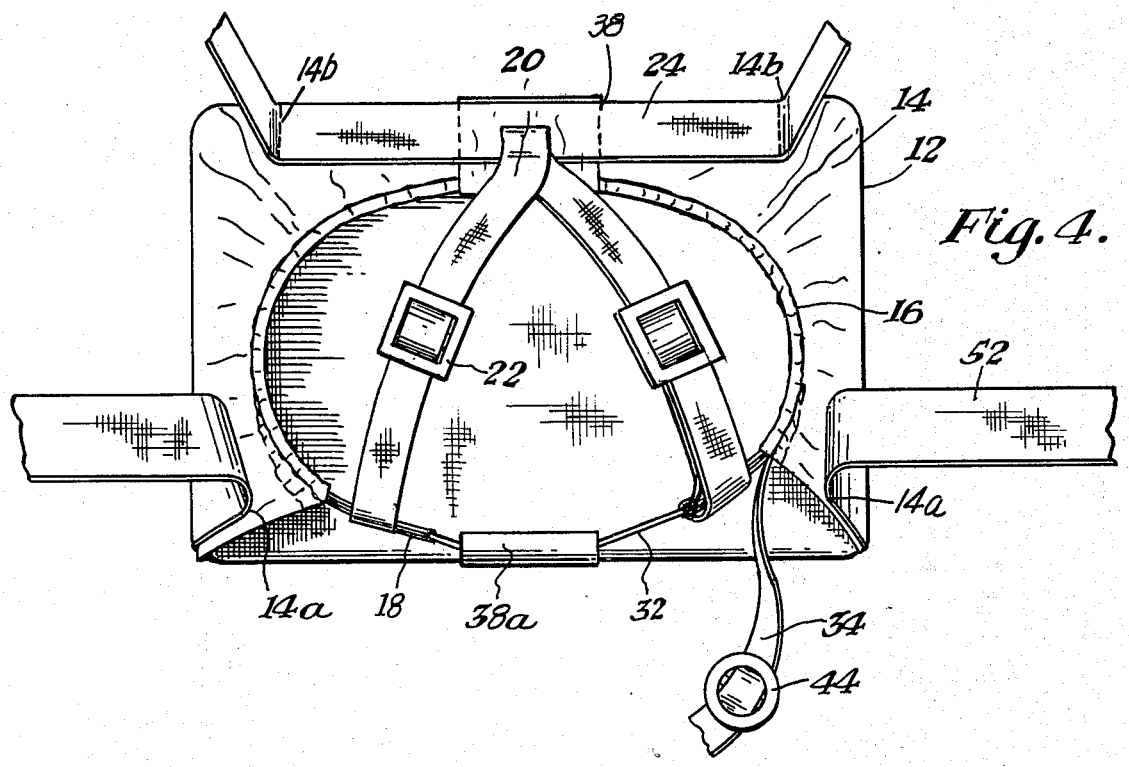
Fig. 4.
Fig. 5.
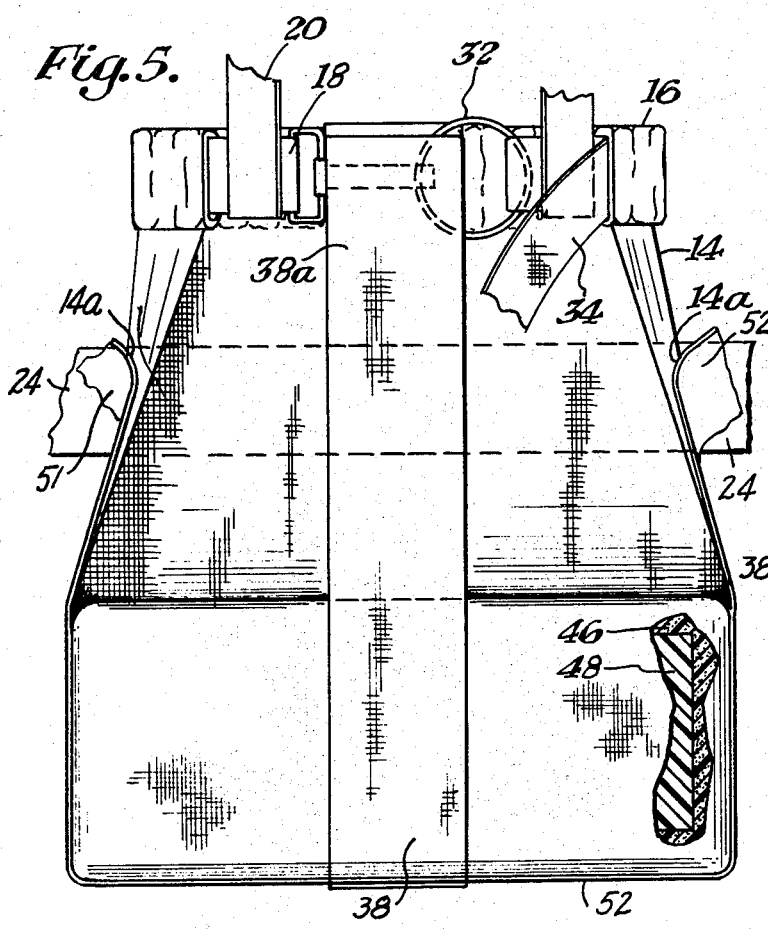
Fig. 6.
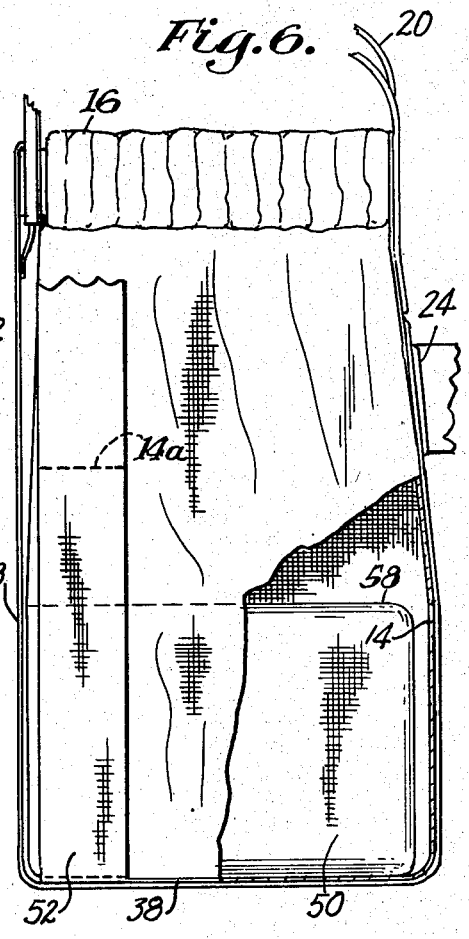

INFANT CARRIER

This application is a continuation-in-part of U.S. Ser. No. 727,180, filed Sept. 27, 1976, and now abandoned.

BACKGROUND OF THE INVENTION

This invention relates generally to an infant carrier that is utilized for transporting an infant, and specifically to a shoulder/trunk-mounted infant seating platform which allows one to transport an infant safely and comfortably and to engage in other activities while supporting and carrying the child.

Devices for transporting infants which are mounted on the shoulders of the carrier are well known in the prior art. For example, U.S. Pat. No. 3,575,326 issued to Chappell, shows an infant carrier having the pouch, which is used to encompass a child's torso and thighs, improperly suspended. Several important deficiencies are found in the prior art. The first deficiency is that by inordinate suspension, infant movement (weight shifting) about the pouch can cause discomfort to the carrier person due to varying strap pressures on the shoulder blades caused by unequal weight distribution. This requires constant readjustment of straps to provide an equalized, yet comfortable, support about the shoulders of the carrier person. Further, movement of the child shifting the center of gravity in the uncontrolled pouch can cause the carrier device to be off balance, requiring additional body movements by the carrier person to compensate for the child's shifting of his center of gravity. A second deficiency found in the prior art is that during carrier-person movement, the infant in the uncontrolled pouch can develop motion relative to the carrier person's body, making it difficult for the carrier person to walk properly or comfortably. Another deficiency is that the improperly suspended pouch is often uncomfortable for the child, while not sufficiently restraining the child's movement. Also, the carrier person can often experience discomfort from the contact of the carrier device pushing against the carrier person's body. Finally, provision is not made to adequately and safely support the infant's spine or head in an upright, yet relaxed position.

The present invention overcomes the deficiencies found in the prior art by providing a stable, yet comfortable, vertically enlarged seating platform which allows for movement of the child or infant upon the platform without causing unnecessary or undesired changes in shoulder strap pressure. The instant invention also provides for an infant stabilizing strap which allows the carrier person to more readily control the position of the infant relative to the torso of the carrier person. The carrier shoulder straps also tension part of the fabric infant compartment wall in front, controlling forward dipping of weight on the platform and giving more leg room for the infant. Adjustable carrier-strap shoulder fasteners facilitate the tightening of the strapping to steadily engage the device in a tilting position against the carrier-person's frontal area. The flexibility of the fabric wall forming the infant compartment allows the child to be positioned against the upper torso of the carrier person, while the enlarged, rear vertical wall of the seating platform distributes the force of the infant's weight more comfortably against the carrier person's body.

BRIEF DESCRIPTION OF THE INVENTION

An infant carrier for protecting an infant's soft backbone structure, settling an infant's unsteady back onto the carrier-person's steady chest in a partially upright, straight-back but relaxed position, having a fabric or other suitable housing, with inner and outer fabric walls on the sides and rear, encasing a seating platform of substantial vertical thickness in the form of a sizably-thick, rigid but lightweight block, padded by foam or other suitable material on all surfaces, the padded block's being removably disposed within the fabric housing. A pair of shoulder/trunk-engaging carrier straps, joined together in one continuous formation by conventional strap adjustment means near or at the shoulders, are connected horizontally along a portion of the rear wall, lying in use adjustably therefrom around the carrier person's rib cage by sliding loops held by a buckle at the back, thence symmetrically around each shoulder and affixed at the diametrically-opposed extent to the forward edges of the bottom-most and side surfaces of the fabric housing walls. An infant-restraining compartment, held up by infant's adjustable shoulder straps, is formed from the three-sided flexible outer wall of the housing (with a front catch/release, leg-partition closure) for underarm encirclement of the infant's torso, while approximately the upper half as well as most of the entire wall is free from the carrier-straps so that the head and torso of the seated infant are not subjected to the dangerous whipping contortions of walls encumbered by tensioned carrier-straps. The carrier-straps are also affixed along the vertical extent of the forward edge of the outer housing wall to within about four inches from the rim on each side of the seat to prevent forward dipping, while also providing more comfortable leg room for the infant. Along the rim of the outer housing wall is an expandable passage in which is a stabilizing strap, one end of which is looped, projected from, fastened to and closing one of the passage's openings, while the other end remains loose for adjustable encirclement around the infant, held in place by a sliding holder on the belt, larger than the entrance of the belt casing, and is long enough to reach around the outside of the walls and the carrier-straps for manipulative control of the infant's posture and movements. Attached to the entrance at the inner side of the passage's open entrance is a looped spur strap to match the loop in the secured end of the long restraining strap, and the two loops hold the catch/release closure which in turn holds a flap or leg partition vertically for supportive security at the infant's crotch, which is connected to the seating platform housing's upper front edge, and also extends beneath the seating platform and up the back of the fabric wall, ending in a loop over the top edge.

The two-way suspension of the seating platform, one by shoulder/trunk-engaging carrier-straps leading from the shoulders to the front edges of the bottom-most and side surfaces, and the other from the chest area to the rear wall, also contribute to the overall hinge-like property of the device, because the inner and outer fabric walls (on the sides and rear) move freely of each other, permitting some movement of the seating platform relative to the outer walls.

The adjustable infant's straps are coupled at one end to the upper rear of the infant restraint compartment for receipt over the shoulders and front torso portion of the infant for holding the restraint compartment wall up without uncomfortable contact, and which also provide an auxiliary means of securing the infant within the carrier. The opposite ends of the infant restraint straps pass through the looped ends of the straps that hold the restraint compartment's catch/release front closure.

The stabilizing strap used in its initial extent to adjustably encircle the infant is of sufficient length to be wrapped around the device between the front shoulder/trunk straps and the carrier person. This adjustable strap can be utilized instantaneously for adjustably fixing the infant relative to the body of the person carrying the child to control the position of the infant. By adjusting the tension on the stabilizing strap, which frictionally engages the carrier-straps and the compartment relative to the torso of the infant, the infant can be positioned adjacent the front torso of the carrier person at any desired degree of snugness. The stabilizing strap can also be held for manipulating the position of the infant during movement of the carrier person.

The outer side and back walls of the fabric housing freely overlap the three inner fabric walls (sides and rear) encompassing the thick seating platform so that the outer housing walls are substantially freely movable relative to the seating platform.

Held on each side to the forward or front carrier-straps by a narrow strip of suitable material is a head-supporting cushion which is removable and adjustable and which allows the infant's head to be rested in either lateral direction against a head cushion. Each strip may issue through the loop on the corresponding carrier-strap adjustment and be backtracked through a loop on the cushion itself. One strap may be longer than the other, reaching from side to side, back of the infant's head beyond the other carrier strap so that its end may be adjustably held together with the end of the shorter strip by a slide fastener.

The infant restraint compartment, including the restraining strap disposed in a passage around the rim, functions somewhat freely with respect to the seating platform and the carrier-straps. Thus, the infant compartment is movable such that a child is supported in a safe, comfortable posture with the spine in a relaxed but straight-back position, while still usable for restraining the child (if unruly) or for comfortably positioning the child (if asleep) or the like in an appropriate position. The device provides an excellent monitoring device on long automobile trips because of its over-all hinge-like property which affords continuous relief on the infant's body from pressure on the seat and because of close personal rapport between infant and the carrier person. Because of its limitless adjustability, the free relative movement of the infant compartment and the adjustability of carrier shoulder straps, the infant carrier described herein, although non-complex in design, is capable of extreme adaptability and proper fitting as the infant is growing up. It is instantaneously adjustable and readily manipulative in every respect, being constructed in such a manner as to avoid the necessity for fumbling or groping with unopenable closures, bindings, etc., beyond the simple flick of a fastener or a pull on a strap.

The vertical size of the padded seating platform is selected to provide a substantial rear surface area that contacts the front torso of the carrier person to reduce the pressure on the carrier person. Applicant has determined that a minimum vertical rear wall height of the platform should be three inches, to achieve a minimum surface area of twenty-four square inches. The interior supporting block surrounded by foam padding can be constructed of a lightweight, yet rigid styrofoam or similar material.

In operation, the device is mounted by first passing onto the shoulders the carrying straps which are attached to the seat's bottom, then placing the carrying strap which is attached to the infant compartment's rear wall onto the lower-front edge of the chest and passing the left and right portions all around the rib cage and locking them together at the back with the sliding loop catch-release fastener for a snug fit, then adjusting the straps at the shoulder connections for a snug overall fit and for a suitable tilt of the seating platform. The infant is raised to the seat, facing forward, the infant straps slipped into place, the front catch/release pushed through the leg partition, and the stabilizing strap pulled to loosely encircle the infant. The infant is ready to be removed from the seat simply after undoing the compartment's front fastener and allowing its shoulder straps and crotch strap to fall down. Because of the simple leg accommodation, there is no awkward tugging or struggling that would take place in pulling the infant's legs from closed entrapment.

It is an object of the invention to provide a lightweight, comfortable infant carrier that safely supports an infant therein and that greatly reduces the burden on the carrier person.

It is another object of the invention to provide an infant carrier that allows for more comfortable mobility of the carrier person with responsive control of the infant and platform.

It is an object of this invention to provide an improved infant carrier that reduces the discomfort on the carrier person while increasing the protective support of the backbone of an infant.

It is another object of this invention to provide an infant carrier which can be readily and manipulatively adjusted so that the person carrying the infant can restrain unwanted motion of the infant.

And yet, still another object of this invention is to provide an infant carrier in which movement of the child on the seating platform will not materially affect the supporting strap force on the shoulders so that the comfort of the carrier person is maintained.

In accordance with these and other objects which will be apparent hereinafter, the instant invention will now be described with particular reference to the accompanying drawings.

BRIEF DESCRIPTION OF THE DRAWINGS

FIG. 4 is a top plan view of the instant invention.

FIG. 5 is a front, fragmentary elevational view partially cutaway of the instant invention.

FIG. 6 is a side elevational view with the carrier straps cutaway of the instant invention, and with a portion of the outer fabric wall cutaway.

PREFERRED EMBODIMENT OF THE INVENTION

Figure 1:
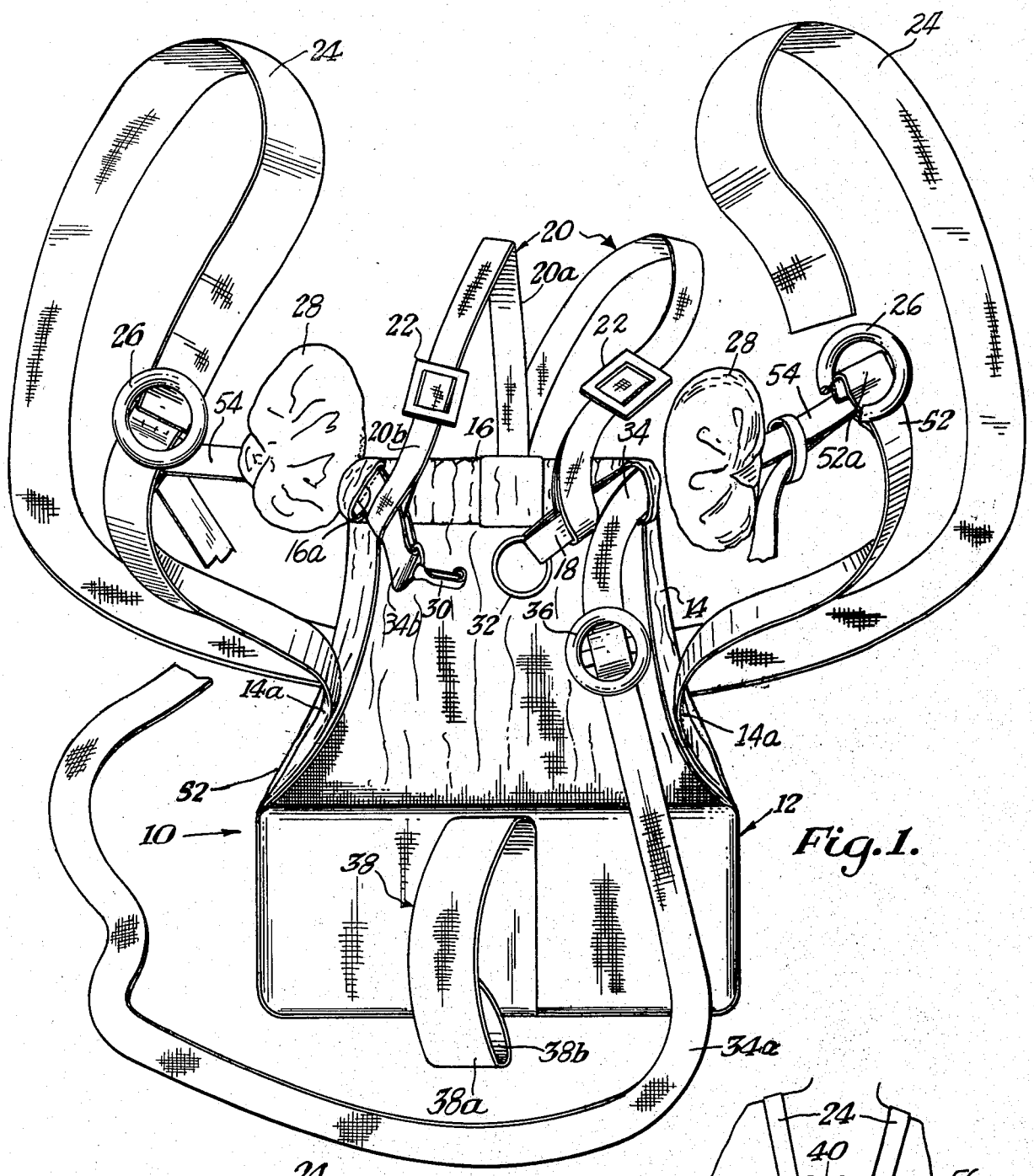
FIG. 1 shows a front, elevational view of the instant invention.

Referring now to FIG. 1, the instant invention is shown generally at 10 made of fabric or other suitable material, encasing a lightweight carrier platform (shown generally at 12), in pocket-like formation with the material projecting upward from the bottommost edges of the platform to form the outer fabric wall 14. The shoulder-engaging carrier straps for supporting the platform are formed by interlocking strap 52 to strap 24 on each side with an adjustment fastener 26. Strap 52 is attached in a continuous expanse by stitching under the platform near the forward edge, as well as on the sides along both front-vertical edges of the outer fabric housing walls and the extent of the fabric wall 14 to about four inches from the rim 16 by stitching 14*a*. Strap 24, which is engaged through sliding fastener 26, is affixed to the rear portion of the fabric wall 14 in an area just above and somewhat short of the platform's horizontal extent, well below the rim of the wall 14.

A removable infant head cushion 28, one on each side, is held by narrow straps 54 issuing through the loop 52*a* on the corresponding carrier strap adjustment fastener 26 with one strap long enough to reach behind the infant's head to the adjustment fastener on the end of the other narrow strap, which is used to adjust the cushions 28 for engagement with the infant's head when desired.

The rim 16 of the three-sided outer fabric wall 14 that forms the infant restraint compartment includes a passage 16*a* for receipt of the infant restraining strap 34, free at one end 34*a*, and having a snap 30 attached at one looped end 34*b*, and a catch 32 held by a looped spur strap 18 attached to the inner side of the passage's open entrance, which is used to restrain the infant in the carrier position. The strap 34 is of sufficient length (adjustable by fastener 36) to be engaged and wrapped around the outside and the front carrier-straps, encompassing the infant. The end 34*a* of strap 34 is held in the hand of the carrier-person and is used to either restrain movement of the infant or to firmly manipulate and position the entire infant carrier. Additional infant restraining straps (shown generally at 20) in conjunction with adjustment fasteners 22 allow for vertical restraint on the infant and also act to lift and suspend the fabric wall 14 in its proper position. A leg partition strap 38, which includes a loop 38*b* near the end 38*a*, is held vertically in position by straps 18 and 34*b* (when snap 30 is coupled to catch 32). The strap 38 acts to restrain the infant in a forward direction and to separate the infant's legs when seated.

Figure 2:
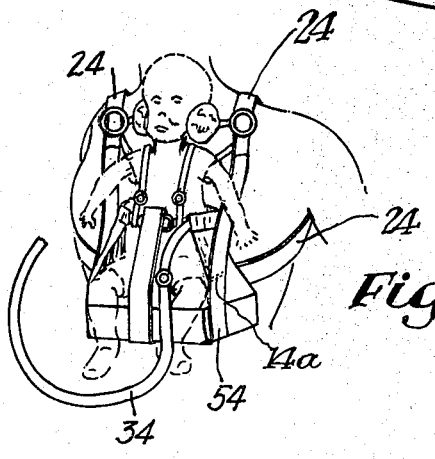
FIG. 2 shows a perspective view of the instant invention with an infant dotted.

Looking at FIG. 2, the device is shown with an infant (shown dotted) supported therein, which shows the positioning of the carrier-straps 24 and 52 in relationship to the carrier-person. Note that the carrier-straps are disposed over the shoulders and proceed around the arms, coming in beneath each arm at an angle to the rear fabric wall of the infant compartment.

Figure 3:
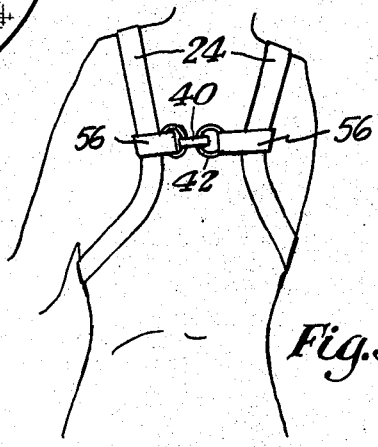
FIG. 3 shows the upper back of a carrier person, the carrier straps, and a slideable loop connector used with the instant invention.

FIG. 3 shows loops 56 moveable along strap 24 connected to a snap fastener 40 that engages catch 42 which connects the carrier strap 24 segments together across the person's back. This connector of the straps 24 aids in stabilizing the carrier-straps and reducing the discomfort by a more equal distribution of strap pressure on the carrier person.

FIG. 4 shows how the carrier-straps 52 and 24 are connected to only a portion of the three-sided compartment formed by fabric wall 14, and specifically strap 52 rises to stitch lines 14*a* (short of the rim 16) for connection while strap 24 is connected horizontally as far as stitch lines 14*b* on the back side of the fabric wall compartment (and to support strap 38) just above the platform and well below the rim, stopping short of the lateral sides of the platform. The relationship of strap 52 is shown in FIG. 5 along point 14*a* where it connects to the fabric wall 14. This attachment relationshlp allows for independent movement of the fabric wall compartment, independent of the carrier-straps. The portion of the carrier-strap 52 attached to the fabric wall above the upper surface 58 of the seating platform, however, provides some vertical support near the front of the device, supporting the leg openings for the infant.

In FIGS. 5 and 6, the seat shown includes an enlarged block 48 of a rigid, lightweight material such as styrofoam surrounded on all sides by foam padding 46. The substantial vertical thickness of block 48 in conjunction with the lateral width presents a sizable surface area that contacts the carrier-person's body on the rear side of the device, distributing the weight-loading force to reduce the pressure on the carrier-person's body. The greater surface area contacting the carrier-person's body also increases the frictional force for stabilizing unwanted movement of the device laterally. The seat surrounded by inner fabric wall 50 is free of the outer wall 14 in the rear and sides (except for attachment to the forward edges of the bottommost and side surfaces) to allow vertical pivotal movement of the seat relative to the walls and the carrier-straps. The anchor locations of the carrier-straps on the fabric wall in conjunction with the pivotal seat achieve a well balanced seating platform that can accommodate infants of varying size and shape, while firmly but comfortably restraining the infant in the fabric wall compartment. Strap 34 enhances the control and stability of the device during movements of the carrier-person. Note that strap 38 is attached from the front wall of the housing, along the bottom wall, and up the back wall, where it attaches to both the carrier strap 24 and infant straps 20. This strap 38 enhances the overall structural support of the seating platform.

The fabric housing may be constructed of a single piece of fabric (or fabric-like material) that has a single layer covering the front, bottom, and top of the seating platform with a double layer (forming the inner and outer walls described above) on the sides and back of the seating platform.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An infant carrier comprising:

an infant seating platform including a lightweight, fairly rigid, cushioned-enveloped block, sized in length and width to seat an infant, said block, including the cushioned envelope, having a substantial vertical thickness, about three inches or more, for engaging the mid-forward torso of a carrier person, said block having a top and a bottom horizontal surface, and front, back and side vertical surfaces;

an inner resilient wall and an outer resilient wall made of a resilient sheet material, said inner wall and said outer wall forming a double wall housing structure for housing said block, said inner wall forming the resilient surface of the rear and two sides of said seating platform, said cushioned-envelope block being removeably housed in a resilient pocket of approximately the same dimensions as said block formed by said inner wall housing structure, said outer wall being a three sided vertical extension of said resilient sheet material, adjoined to the bottommost edges of said seating platform and having a height of about ten inches, overlapping said inner wall, said inner and outer walls being moveable relative to each other, said outer wall having a portion disposed above the upper surface of said seating platform serving as a resilient three sided infant restraining compartment having an upper expandable rim;

a pair of carrier person, two shoulder, trunk engaging straps for suspending, positioning, and holding the seating platform strategically and integrally close and steady within a narrow range on the carrier-person's front torso, but loose enough for said seating platform to have a hinging property for easing the impact of shifting weight, a rectangular portion of said carrier person strap sized in length less than the side to side dimension of the seat, said carrier person strap portion connected horizontally to the outside of said compartment back outer wall in a lateral direction, the top edge of said rectangular strap portion being attached about midway from said back outerwall, uppermost rim and the bottom most of said platform, said carrier person straps held tightly around the carrier person's rib cage by a pair of releasably joined loops, one of each said loops moveably mounted on one of each of the two sections of said carrier person's strap for adjusting the carrier person strap tension on the back torso of the carrier person, the diametrically opposed straps extending symetrically through said loops, over both carrier persons shoulders, along the underside of, and on the sides of, said seating platform, along the forward edges, and connected along part of the forward edges of the outer wall to within about midway of said outer walls uppermost rim and the bottom most edges of said platform, a pair of adjustment fasteners connected to said strap, said carrier person's straps being adjustable relative to each other in length for adjustment to the carrier person, and for adjustment of said seating platforms tilt;

an infant leg partition member connected to the forward wall of said seating platform and having a free looped end disposed above the upper surface of said seating platform, the other end of said partition member being disposed along the forward, bottom, and back walls of said seating platform and looped over said back outer wall;

means for releasably coupling the upper ends of said outer walls together through said partition loop;

a pair of removable infant side-headrests; and a pair of narrow straps each connected to a different infant side-headrest, each of said narrow straps issuing through a loop which holds the adjustment fasteners of the carrier persons shoulder straps, each of said side-headrests being a small cushion, one of said narrow straps being long enough to reach from side to side behind the infant's head and beyond the opposing carrier person's shoulder strap so that the end of said longer narrow straps may be adjustably held with the end of the other of said pair of narrow straps by a slide fastener.

2. An infant carrier as in claim 1, including:

an expandable passage disposed at the top of said infant restraining compartment;

a draw strap having the segment disposed throughout said passage and a portion disposed outside said passage, the free end of said draw strap being long enough to reach around the infant for a second encirclement and being either manually held around both said carrier person straps and the infant by the carrier person for controlling said infant carrier, or placed handily loose with the end coupled in the sliding fastener on said draw strap; and a pair of infant restraining straps adjustable in length, each connected to the rear wall of said resilient compartment and looped at each opposite end through said means for coupling the upper ends of said outer walls.

* * * * *